US012295437B2

(12) United States Patent
Moss et al.

(10) Patent No.: US 12,295,437 B2
(45) Date of Patent: May 13, 2025

(54) GARMENT WITH CONCEALED FIREARM HOLSTER

(71) Applicants: LaMarr Moss, McKinney, TX (US); Shane Rollins, McKinney, TX (US)

(72) Inventors: LaMarr Moss, McKinney, TX (US); Shane Rollins, McKinney, TX (US)

( * ) Notice: Subject to any disclaimer, the term of this patent is extended or adjusted under 35 U.S.C. 154(b) by 0 days.

(21) Appl. No.: 18/066,614

(22) Filed: Dec. 15, 2022

(65) Prior Publication Data

US 2023/0189909 A1 Jun. 22, 2023

Related U.S. Application Data

(60) Provisional application No. 63/290,677, filed on Dec. 17, 2021.

(51) Int. Cl.

| | |
|---|---|
| ***A41D 27/20*** | (2006.01) |
| ***F41C 33/02*** | (2006.01) |
| ***F41C 33/04*** | (2006.01) |

(52) U.S. Cl.

CPC ..... *A41D 27/20* (2013.01); *F41C 33/0218* (2013.01); *F41C 33/048* (2013.01)

(58) Field of Classification Search

CPC .... A41D 27/20; F41C 33/048; F41C 33/0218

USPC ..... 2/250

See application file for complete search history.

(56) References Cited

U.S. PATENT DOCUMENTS

| | | | | | |
|---|---|---|---|---|---|
| 4,235,356 | A | * | 11/1980 | Atchisson | F41C 33/0209 224/192 |
| 4,637,075 | A | * | 1/1987 | Ingrisano | A61F 17/00 2/253 |
| 4,966,320 | A | * | 10/1990 | DeSantis | F41C 33/0209 224/931 |
| 5,170,919 | A | * | 12/1992 | DeSantis | F41C 33/048 224/931 |
| 5,724,679 | A | * | 3/1998 | Hans | A41D 27/20 2/249 |
| 5,870,777 | A | * | 2/1999 | Hans | A41D 1/089 2/249 |
| 5,884,338 | A | * | 3/1999 | Golde | A41D 27/20 224/660 |
| 6,131,198 | A | * | 10/2000 | Westrick | F41C 33/048 2/2.5 |
| 7,058,987 | B2 | | 6/2006 | Salazar | |
| 7,681,255 | B2 | | 3/2010 | Morales et al. | |

(Continued)

*Primary Examiner* — Jocelyn Bravo

(74) *Attorney, Agent, or Firm* — Boudwin Intellectual Property Law, LLC; Daniel Boudwin

(57) ABSTRACT

A garment with a concealed firearm holster is provided. The garment includes a garment body having an upper waist opening and a pair of leg sleeves, wherein each leg sleeve of the pair of leg sleeves includes a lower leg opening. A hip holster pocket is disposed on an interior surface of the garment body adjacent to the upper waist opening. In some embodiments, concealment pocket is affixed to the garment body along at least one leg sleeve of the pair of leg sleeves. The concealment pocket includes a flap removably securable to at least one leg sleeve along an upper edge and opposing lateral edges of the flap defining a closed position. A holster pocket is affixed to the at least one leg sleeve along three edges thereof to define an open upper end. The flap overlies the holster pocket when the flap is in the closed position.

12 Claims, 5 Drawing Sheets

(56) References Cited

U.S. PATENT DOCUMENTS

| | | | | |
|---|---|---|---|---|
| 7,743,430 | B2 * | 6/2010 | Jennings | A45C 1/04 2/94 |
| 8,074,850 | B2 * | 12/2011 | Soderquist | F41C 33/0227 224/912 |
| 8,307,465 | B2 | 11/2012 | French et al. | |
| 8,484,765 | B2 | 7/2013 | French | |
| 8,522,367 | B2 | 9/2013 | French et al. | |
| 8,839,464 | B2 | 9/2014 | French | |
| 8,856,970 | B2 | 10/2014 | French | |
| 9,370,211 | B2 * | 6/2016 | Yee | A41D 27/208 |
| 9,513,084 | B1 * | 12/2016 | Baugh | F41C 33/0209 |
| 9,557,139 | B1 * | 1/2017 | Miner | A44B 18/0073 |
| 2003/0205595 | A1 * | 11/2003 | Young | F41C 33/0218 224/230 |
| 2005/0223466 | A1 * | 10/2005 | Jennings | A41D 13/0012 2/102 |
| 2012/0117713 | A1 | 5/2012 | Hoffner | |
| 2013/0015225 | A1 * | 1/2013 | Hogue | F41C 33/0272 224/587 |
| 2015/0082506 | A1 * | 3/2015 | Yee | A41D 27/204 2/69 |
| 2015/0089708 | A1 | 4/2015 | Trevino | |
| 2017/0049181 | A1 * | 2/2017 | Deters | A43B 3/0031 |
| 2018/0084844 | A1 * | 3/2018 | Amezcua | F41C 33/048 |
| 2019/0339040 | A1 * | 11/2019 | Mills | F41C 33/0227 |
| 2020/0068968 | A1 * | 3/2020 | Robinson | A41D 1/08 |
| 2022/0187044 | A1 * | 6/2022 | Calvo | F41C 33/0227 |

* cited by examiner

GARMENT WITH CONCEALED FIREARM HOLSTER

CROSS REFERENCE TO RELATED APPLICATIONS

This application claims the benefit of U.S. Provisional Application No. 63/290,677 filed on Dec. 17, 2021. The above identified patent application is herein incorporated by reference in its entirety to provide continuity of disclosure.

BACKGROUND OF THE INVENTION

The present invention relates to garments with hidden pockets. More particularly, the present invention pertains to a garment having an integrated holster pocket on an interior surface of the garment body adjacent to the upper waist opening. Furthermore, some embodiments feature an additional holster pocket hidden beneath a flap configured to mimic a cargo pocket to disguise the holster pocket thereunder.

In multiple states, gun owners may carry their firearm freely and openly, however, in some states, gun owners may only have the legal right to carry the firearm in a concealed manner. In order to carry a firearm safely and legally in a concealed manner, a holster or other device is required that can support the firearm such that the firearm is hidden from view. A common solution for concealed carry is a waist holster, which is typically secured to the user's belt or placed between their body and the waist of their pants. Wearing a waist holster may often be uncomfortable over extended periods of use. Alternatively, individuals may choose to conceal the firearm within their clothing, however such carrying can be dangerous as the firearm is not properly secured which could result in an accidental discharge. Providing a comfortable and secure means of concealing a firearm on an individual's person will prevent accidental discharge while maximizing comfort. In order to address these concerns, the present invention will provide users with a pair of pants featuring an integrated and concealed holster capable of carrying a firearm.

In light of the devices disclosed in the known art, it is submitted that the present invention substantially diverges in design elements from the known art and consequently it is clear that there is a need in the art for an improvement to existing garments with hidden pockets. In this regard, the instant invention substantially fulfills these needs.

SUMMARY OF THE INVENTION

In view of the foregoing disadvantages inherent in the known types of garments now present in the known art, the present invention provides a garment with a concealed firearm holster wherein the same can be utilized for providing convenience for the user when carrying a firearm in a concealed manner designed to appear as a traditional garment.

The present system comprises a garment body having an upper waist opening and a pair of leg sleeves, wherein each leg sleeve of the pair of leg sleeves comprises a lower leg opening. In some embodiments, a concealment pocket is affixed to the garment body along at least one leg sleeve of the pair of leg sleeves, wherein the concealment pocket comprises a flap removably securable to the at least one leg sleeve along an upper edge and opposing lateral edges of the flap defining a closed position. A holster pocket is affixed to the at least one leg sleeve, wherein the holster pocket is affixed along three edges thereof defining an open upper end. The flap overlies the holster pocket when the flap is in the closed position. In some embodiments, a hip holster pocket is disposed on an interior surface of the garment body adjacent to the upper waist opening.

In some embodiments, the holster pocket comprises an elastic mesh biased inwardly towards the at least one leg sleeve. In another embodiment, a strap is affixed adjacent to the open upper end, wherein the strap comprises a fastener on a distal end of the strap, wherein the fastener is removably securable to a complementary fastener disposed on an exterior of the holster pocket. In other embodiments, the holster pocket is subdivided into a first pocket portion and a second pocket portion via a seam disposed perpendicular to a lower end of the holster. In yet another embodiment, the first pocket portion comprises a larger area than the second pocket portion, such that the first pocket portion is dimensioned to receive a firearm and the second pocket portion is dimensioned to receive a magazine. In some embodiments, the flap is removably securable to the at least one leg sleeve via flap fasteners disposed along the opposing lateral edges and the upper edge, the flap fasteners removably securable to complementary flap fasteners disposed on the at least one leg sleeve. In another embodiment, a slit is disposed through the holster pocket disposed parallel to a lower end of the holster pocket, wherein the slit is dimensioned to receive a firearm barrel therethrough. In other embodiments, a zipper is disposed along a lower edge of the flap, wherein the zipper removably secures the lower edge of the flap to the at least one leg sleeve. In yet another embodiment, the flap further comprises a faux closure on an exterior side of the flap along the upper edge of the flap. In some embodiments, a hip strap is affixed adjacent to an open upper end of the hip holster pocket, wherein the hip strap comprises a fastener on a distal end of the hip strap, the fastener removably securable to a complementary fastener disposed on an exterior of the hip holster pocket. In another embodiment, the hip holster pocket is subdivided into a firearm pocket portion and a magazine pocket portion via a seam disposed perpendicular to a lower end of the hip holster pocket.

BRIEF DESCRIPTION OF THE DRAWINGS

Although the characteristic features of this invention will be particularly pointed out in the claims, the invention itself and manner in which it may be made and used may be better understood after a review of the following description, taken in connection with the accompanying drawings wherein like numeral annotations are provided throughout.

DETAILED DESCRIPTION OF THE INVENTION

Figure 1:
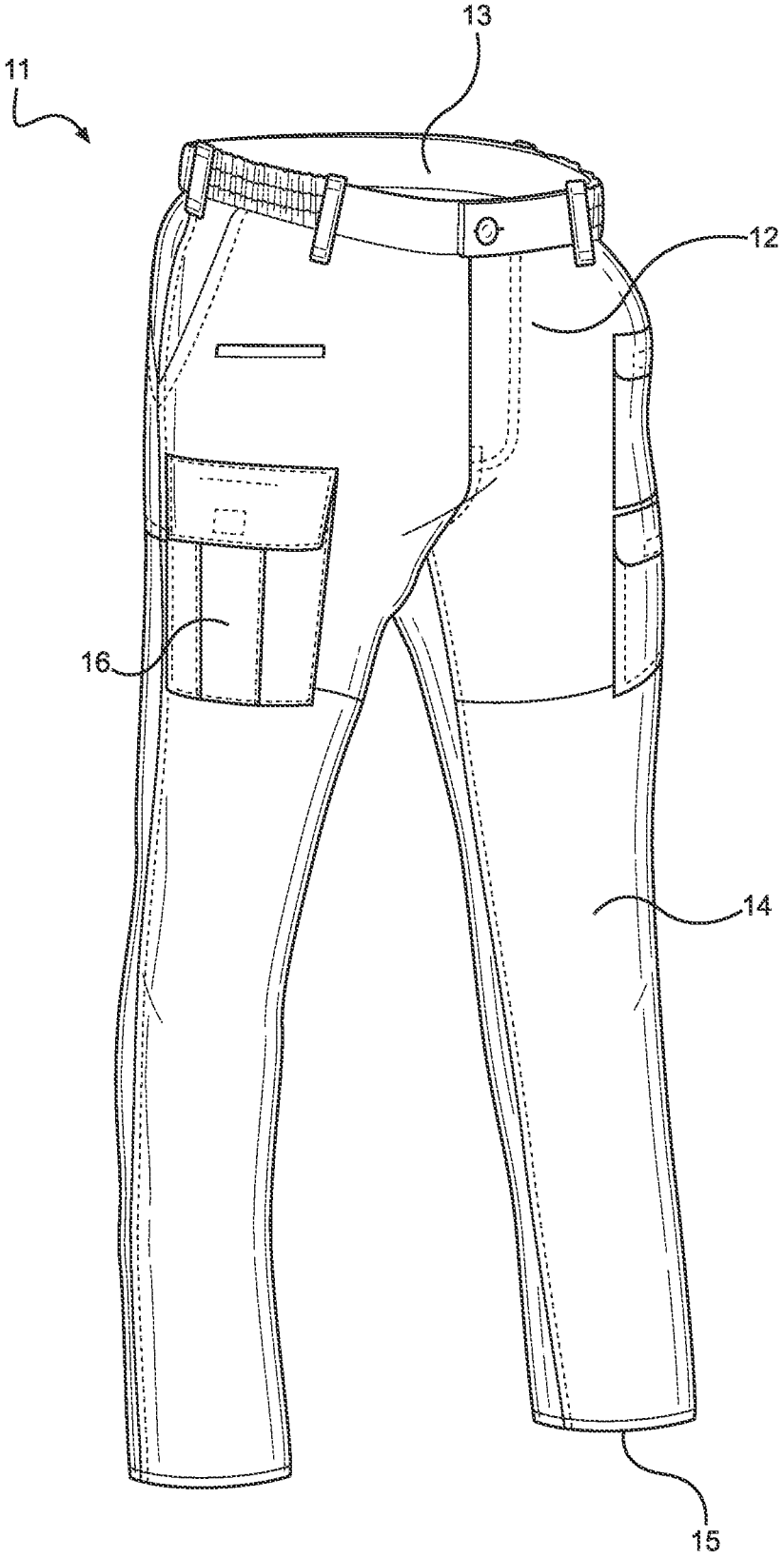
FIG. 1 shows a perspective view of an embodiment of the garment with a concealed firearm holster.

Reference is made herein to the attached drawings. Like reference numerals are used throughout the drawings to depict like or similar elements of the garment with a concealed firearm holster. The figures are intended for representative purposes only and should not be considered to be limiting in any respect.

Referring now to FIG. 1, there is shown a perspective view of an embodiment of the garment with a concealed firearm holster. The garment with a concealed firearm holster 11 comprises a garment body 12 having an upper waist opening 13 and a pair of leg sleeves 14, wherein each of the pair of leg sleeves 14 terminate in a lower leg opening 15. In the illustrated embodiment, the pair of leg sleeves 14 comprise a full length pant leg, however, in alternate embodiments, various styles of pant are contemplated with various lengths of pant leg. In the shown embodiment, the upper waist opening 13 comprises an elastic waistband having a plurality of belt loops therearound. In the shown embodiment, a concealment pocket 16 is disposed on at least one leg sleeve of the pair of leg sleeves 14, wherein the concealment pocket 16 is configured to mimic a pocket traditionally found on a pair of pants, for example, in the shown embodiment, a cargo pocket suited for tactical or cargo pants. The concealment pocket 16 further encloses a holster pocket (as shown in FIG. 2B, 20), such that when the concealment pocket 16 is secured to the leg sleeve, the holster pocket is fully concealed thereby as further described elsewhere herein. In the shown embodiment, additional features common to traditional garments are further incorporated, including several differing pocket styles and locations, such as pouch-style side pockets, flap-style side pockets, left and right upper pockets, and the like, waist fastener, fly, and the like. While the associated figures illustrate a particular style of garment, alternate garment styles with a concealment pocket 16 and associated holster pocket are contemplated. Furthermore, as elsewhere described herein, a hip holster pocket (as shown in FIG. 3, 36) is disposed along the upper waist opening 13 in embodiments of garment where a tactical or cargo pocket design are undesirable.

Figure 2A:
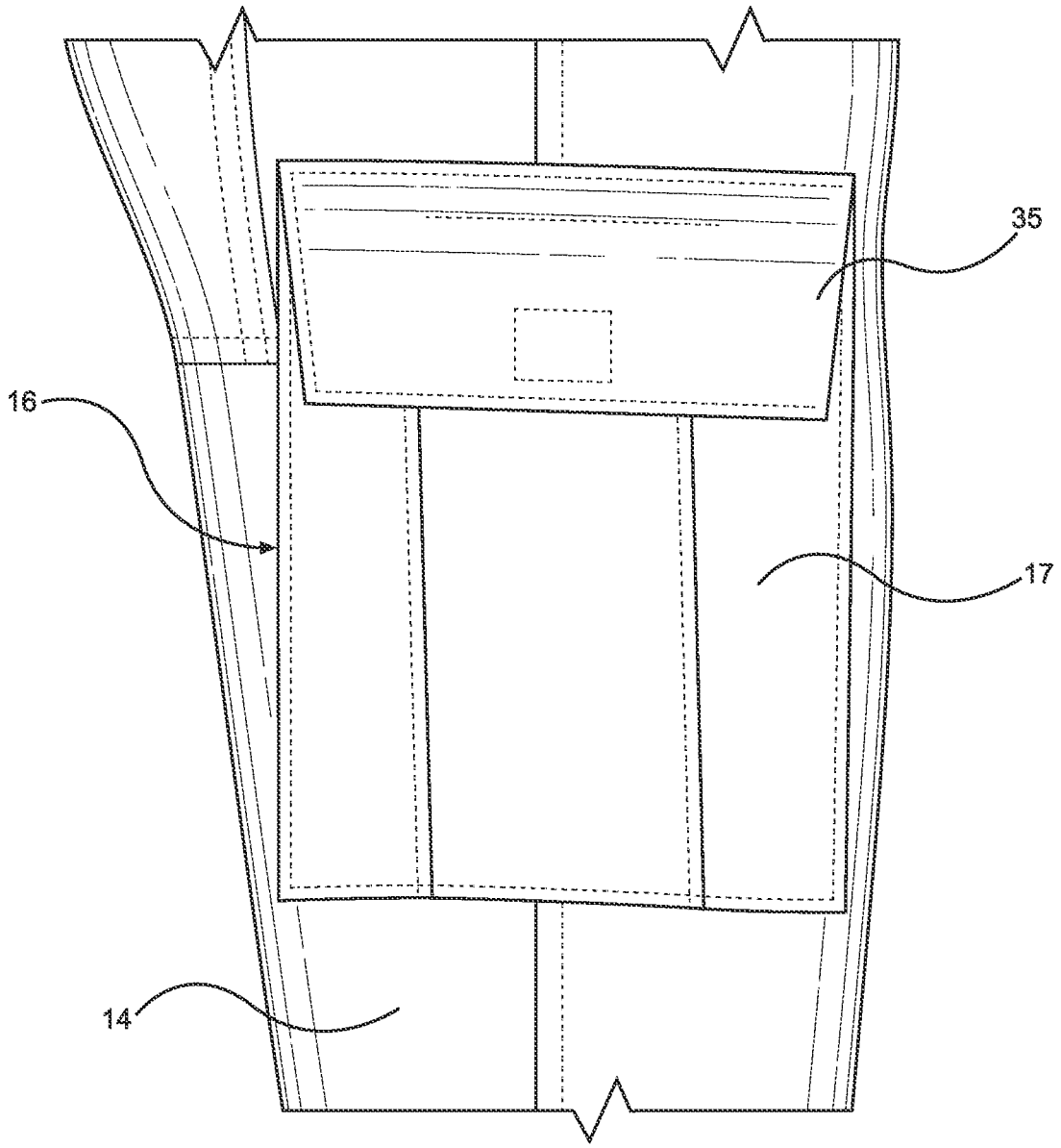
FIG. 2A shows a plan view of the flap of an embodiment of the garment with a concealed firearm holster in a closed position.
Figure 2B:
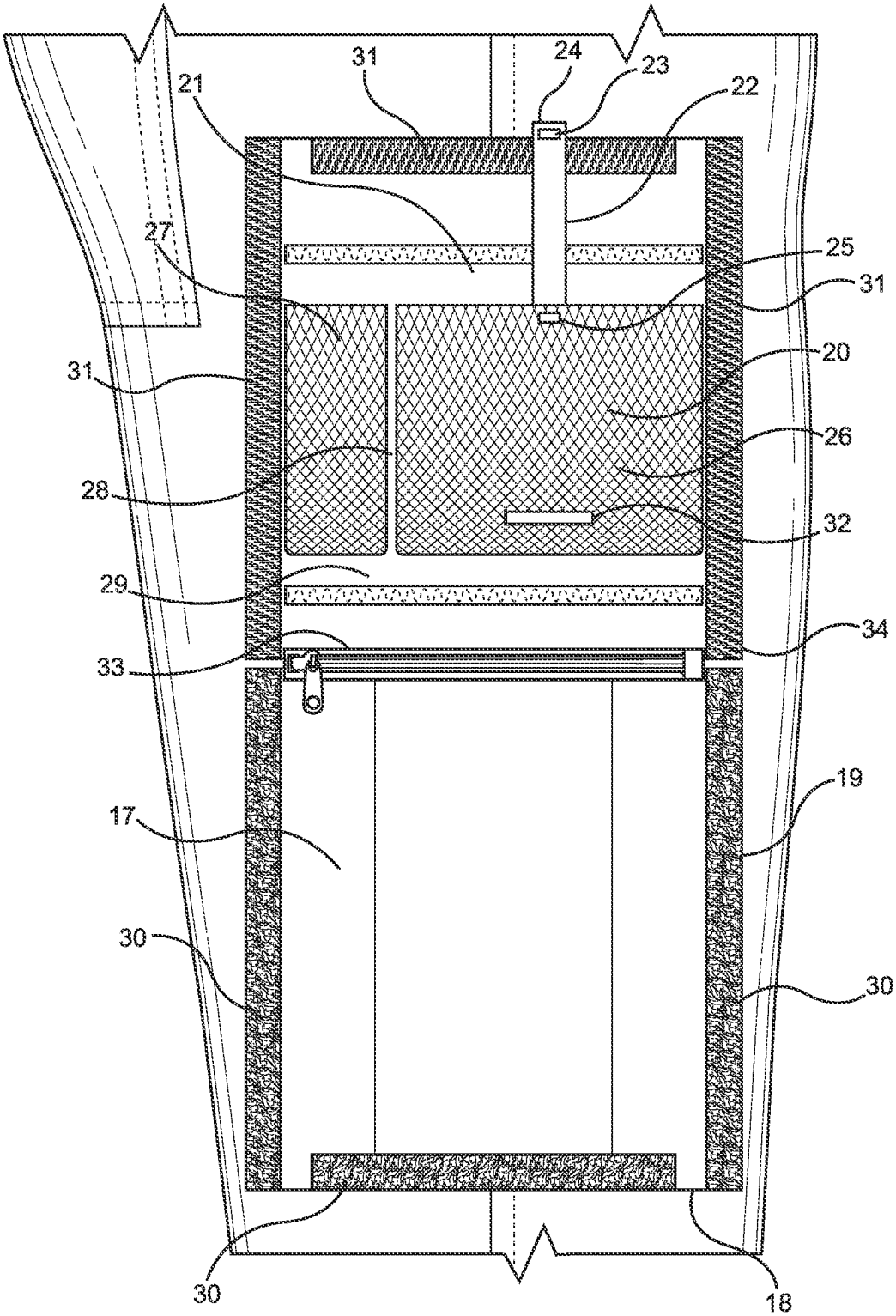
FIG. 2B shows a plan view of the flap of an embodiment of the garment with a concealed firearm holster in an open position.

Referring now to FIGS. 2A and 2B, there is shown a plan view of the flap of an embodiment of the garment with a concealed firearm holster in a closed position and a plan view of the flap of an embodiment of the garment with a concealed firearm holster in an open position, respectively. In the illustrated embodiment, the concealment pocket 16 is disposed on at least one leg sleeve of the pair of leg sleeves 14 at or about the location of the wearer's thigh. The concealment pocket 16 may be disposed on either side of the garment body to accommodate the wearer's dominant hand or shooting hand preferences. In the shown embodiment, the flap 17 further comprises a faux closure 35 thereon, wherein the faux closure 35 is configured to further disguise the concealment pocket 16 as a traditional pocket. In the shown embodiment, the faux closure 35 comprises a flap closure foldable over an upper side of the concealment pocket 16. The concealment pocket 16 further comprises a flap 17 affixed to the leg sleeve along a lower edge 34 of the flap, such that the flap 17 selectively folds along the lower edge 34 to expose the holster pocket 20 disposed below the flap 17. The flap 17 is retained on the leg sleeve via one or more flap fasteners 30 disposed along an upper edge 18 of the flap 17 and opposing lateral edges 19 of the flap 17, wherein the flap fasteners 30 are removably securable to complementary flap fasteners 31 disposed on the leg sleeve 14. In the shown embodiment, the flap fasteners 30 and the complementary flap fasteners 31 comprise hook and loop fasteners, however, alternate securement means are also contemplated. As such, when the user requires access to the holster pocket 20, the user can detach the opposing lateral edges 19 and the upper edge 18 from the leg sleeve 14 to expose the underlying holster pocket 20. Furthermore, in the illustrated embodiment, the flap 17 is removably securable from the leg sleeve 14 via a zipper fastener 33 disposed along the lower edge 34 of the flap 17, such that when the concealment pocket 16 is no longer necessary, the user can detach the flap 17 to provide free access to the holster pocket 20 while avoiding encumbering the user with a dangling piece of fabric.

The holster pocket 20 is affixed to the leg sleeve 14 along three edges thereof, such that an upper end 21 of the holster pocket 20 is open for inserting objects therein. The flap 17 overlies the holster pocket 20 when the flap 17 is affixed to the complementary flap fasteners 31, such that the holster pocket 20 is fully concealed thereby. In the shown embodiment, the holster pocket 20 comprises an elastic mesh configured to retain a firearm, magazine, or other firearm accessories therein. The elastic mesh is biased inwardly towards the leg sleeve 14 such that items placed within the holster pocket 20 are frictionally engaged thereby. In the shown embodiment, the holster pocket 20 is further subdivided into a first holster portion 26 and a second holster portion 27, wherein the first and second holster portions 26, 27 are dimensioned to receive a firearm and a magazine therein, respectively. As such, in the shown embodiment, the first holster portion 26 comprises a larger area than the second holster portion 27. The first and second holster portions 26, 27 are separated via a seam 28 extending perpendicularly from a lower end 29 of the holster pocket 20. In the illustrated embodiment, a strap 22 is affixed adjacent to the open upper end 21 of the holster pocket 20, wherein the strap 22 is configured to removably secure to an exterior of the holster pocket 20 to retain a firearm within an interior of the holster pocket. To facilitate this securement, a fastener 23 is disposed on a distal end 24 of the strap 22, wherein the fastener 23 is removably securable to a complementary fastener 25 disposed on the exterior of the holster pocket 20. In embodiments having a first and second pocket portions 26, 27, the strap 22 is affixed adjacent to the first pocket portion 26 to engage a firearm secured therein. In some embodiments, a slit 32 is disposed through the holster pocket 20 parallel to the lower end 29 of the holster pocket 20, wherein the slit 32 is dimensioned to receive a firearm barrel therethrough.

Figure 3:
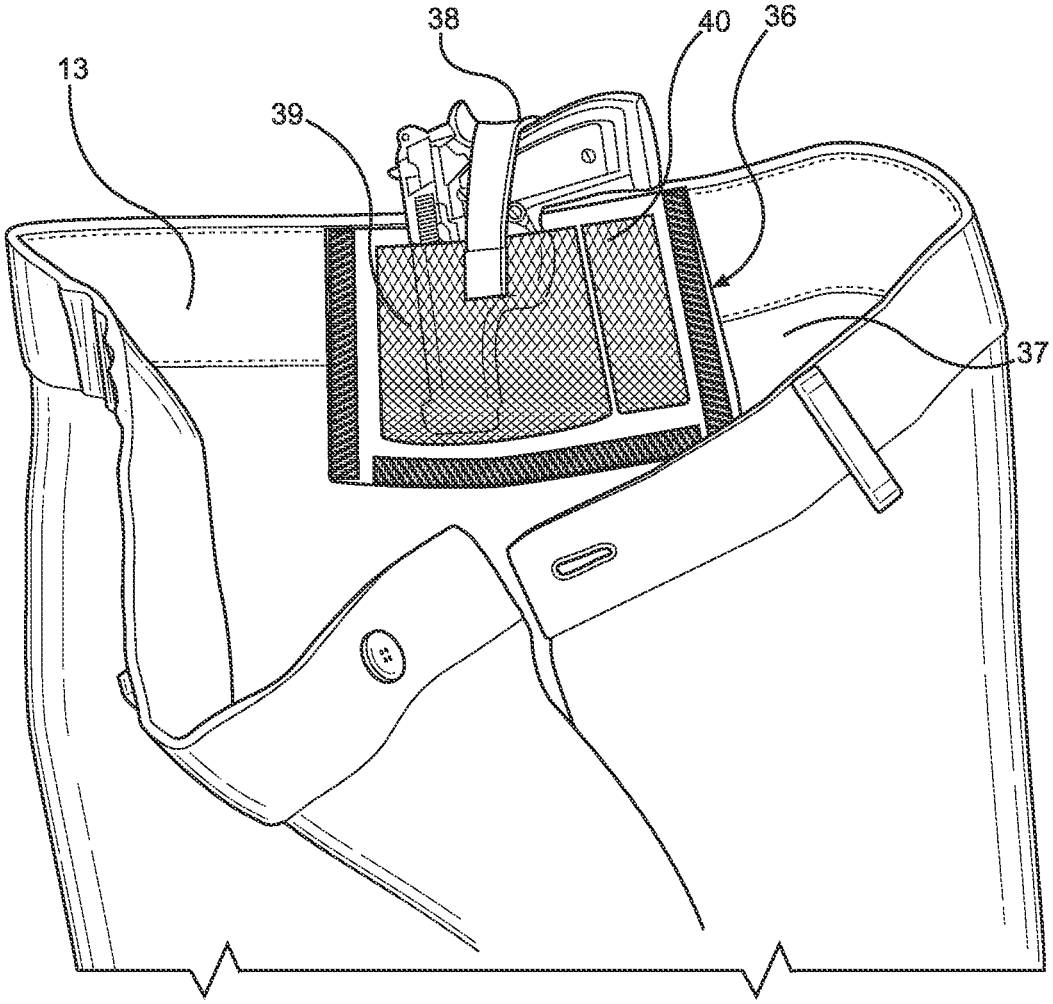
FIG. 3 shows a perspective view of the hip holster pocket of an alternate embodiment of the garment with a concealed firearm holster.

Referring now to FIG. 3, there is shown a perspective view of the hip holster pocket of an alternate embodiment of the garment with a concealed firearm holster. In the illustrated embodiment, the garment comprises a hip holster pocket 36 disposed on an interior surface 37 of the garment body adjacent to the upper waist opening 13. In this manner, the hip holster pocket 36 mimics a traditional interior waist holster. The hip holster pocket 36 is contemplated to be utilized in combination with the concealment pocket previously described, or alternatively in isolation. For example, should the garment body be designed to mimic a style of pant in which a cargo pocket is undesirable or otherwise unavailable, the hip holster pocket 36 provides a concealed holster integrated with the garment body. Additionally, in garment body styles where cargo pockets are appropriate, the hip holster pocket 36 provides an additional or alternative firearm storage location. The hip holster pocket 36 may be positioned opposite the fly and waist fastener of the garment, such that a firearm disposed within the hip holster pocket 36 is maintained at the small of a user's back, or alternatively may be positioned along the upper waist opening as determined by user preference. The hip holster pocket 36 is otherwise contemplated to be substantially identical to the holster pocket as previously described above. For example, in some embodiments, the hip holster pocket 36 comprises an elastic mesh biased inwardly towards the garment to retain the firearm therein. In the illustrated embodiment, the hip holster pocket 36 is subdivided into a firearm pocket portion 39 and a magazine pocket portion 40 via a seam disposed perpendicular to the lower end of the hip holster pocket 36. A hip strap 38 is affixed adjacent to the open upper end of the hip holster pocket 36, wherein the hip strap 38 further comprises a fastener removably securable to a complementary fastener disposed on an exterior surface of the hip holster pocket 36. The hip strap 38 is configured to frictionally engage a firearm to retain the firearm within the hip holster pocket 36. In the shown embodiment, the hip strap 38 is disposed adjacent to the firearm pocket portion 39 to engage the firearm disposed therein.

Figure 4:
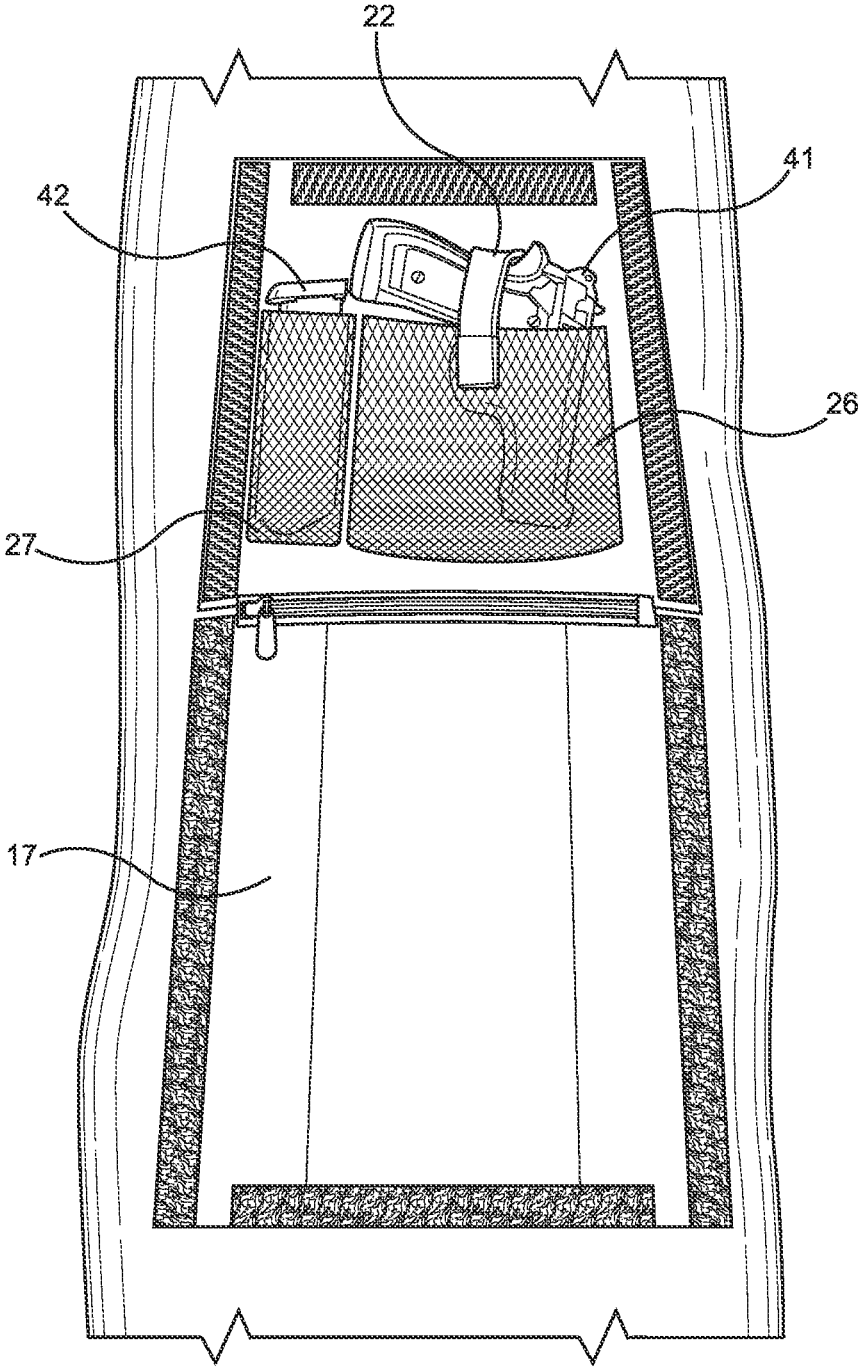
FIG. 4 shows a perspective view of an embodiment of the garment with a concealed firearm holster in use.

Referring now to FIG. 4, there is shown a perspective view of an embodiment of the garment with a concealed firearm holster in use. In one use, a firearm 41 can be placed within the first pocket portion 26 of the holster pocket such that the firearm 41 is retained therein via the retention force of the elastic mesh. The strap 22 can be secured over the grip of the firearm 41 to further ensure that the firearm remains in a desired position during use. A magazine 42 may further be inserted into the second pocket portion 27 of the holster pocket to provide access thereto when necessary. Once the firearm 41 is secured within the holster pocket, the flap 17 can be affixed to the leg sleeve via the flap fasteners and complementary flap fasteners, such that the flap 17 overlies the holster pocket and conceals the firearm 41 disposed therein. As the exterior surface of the flap 17 comprises a faux closure and other textures to mimic a traditional pocket, the holster pocket is wholly concealed thereby, allowing the garment to resemble a traditional pair of pants. Should the user require access to the firearm 41, the flap 17 can be detached from the leg sleeve exposing the holster pocket and the associated firearm 41. Should the flap 17 become cumbersome or otherwise get in the user's way, the flap 17 may be detached entirely from the leg sleeve via the zipper fastener disposed along the lower edge of the flap 17 (as shown in FIG. 2B). In this manner, the user is provided with a garment that resembles a traditional pair of pants, while further having a hidden holster pocket disposed beneath a quickly detachable flap for efficient and timely access to a firearm.

It is therefore submitted that the instant invention has been shown and described in various embodiments. It is recognized, however, that departures may be made within the scope of the invention and that obvious modifications will occur to a person skilled in the art. With respect to the above description then, it is to be realized that the optimum dimensional relationships for the parts of the invention, to include variations in size, materials, shape, form, function and manner of operation, assembly, and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A garment with a concealed firearm holster, the garment comprising:

a garment body having an upper waist opening and a pair of leg sleeves, wherein each leg sleeve of the pair of leg sleeves comprises a lower leg opening;

a concealment pocket affixed to the garment body along at least one leg sleeve of the pair of leg sleeves;

wherein the concealment pocket comprises a flap removably securable to the at least one leg sleeve along an upper edge and opposing lateral edges of the flap defining a closed position;

a holster pocket affixed to the at least one leg sleeve;

wherein the holster pocket is affixed to the at least one leg sleeve along three edges thereof defining an open upper end;

a hip holster pocket disposed on an interior surface of the garment body adjacent to the upper waist opening;

wherein the flap overlies the holster pocket when the flap is in the closed position;

wherein the flap further comprises a faux closure on an exterior side of the flap along the upper edge of the flap;

a strap affixed adjacent to the open upper end, wherein the strap comprises a fastener on a distal end of the strap, the fastener removably securable to a complementary fastener disposed on an exterior of the holster pocket; and a zipper disposed along a lower edge of the flap, wherein the zipper removably secures the lower edge of the flap to the at least one leg sleeve.

2. The garment with a concealed firearm holster of claim 1, wherein the holster pocket comprises an elastic mesh biased inwardly towards the at least one leg sleeve.

3. The garment with a concealed firearm holster of claim 1, wherein the holster pocket is subdivided into a first pocket portion and a second pocket portion via a seam disposed perpendicular to a lower end of the holster pocket.

4. The garment with a concealed firearm holster of claim 3, wherein the first pocket portion comprises a larger area than the second pocket portion, such that the first pocket portion is dimensioned to receive a firearm and the second pocket portion is dimensioned to receive a magazine.

5. The garment with a concealed firearm holster of claim 1, wherein the flap is removably securable to the at least one leg sleeve via flap fasteners disposed along the opposing lateral edges and the upper edge, the flap fasteners removably securable to complementary flap fasteners disposed on the at least one leg sleeve.

6. The garment with a concealed firearm holster of claim 1, further comprising a slit through the holster pocket disposed parallel to a lower end of the holster pocket, wherein the slit is dimensioned to receive a firearm barrel therethrough.

7. The garment with a concealed firearm holster of claim 1, wherein the hip holster pocket comprises an elastic mesh biased inwardly towards the interior surface.

8. The garment with a concealed firearm holster of claim 1, wherein an open upper end of the hip holster pocket is disposed substantially flush with the upper waist opening of the garment body.

9. The garment with a concealed firearm holster of claim 1, further comprising a hip strap affixed adjacent to the open upper end, wherein the hip strap comprises a fastener on a distal end of the hip strap, the fastener removably securable to a complementary fastener disposed on an exterior of the hip holster pocket.

10. The garment with a concealed firearm holster of claim 1, wherein the hip holster pocket is subdivided into a firearm pocket portion and a magazine pocket portion via a seam disposed perpendicular to a lower end of the hip holster pocket.

11. The garment with a concealed firearm holster of claim 10, wherein the firearm pocket portion comprises a larger area than the magazine pocket portion, such that the firearm pocket portion is dimensioned to receive a firearm and a magazine pocket portion is dimensioned to receive a magazine.

12. The garment with a concealed firearm holster of claim 1, further comprising a slit through the hip holster pocket disposed parallel to a lower end of the hip holster pocket, wherein the slit is dimensioned to receive a firearm barrel therethrough.

* * * * *